US005248389A

United States Patent [19]

Heimburger et al.

[11] Patent Number: 5,248,389

[45] Date of Patent: Sep. 28, 1993

[54] PROCESS FOR PEROXIDE BLEACHING OF MECHANICAL PULP USING SODIUM CARBONATE AND NON-SILICATE CHELATING AGENTS

[75] Inventors: Stanley A. Heimburger; Steve E. Tremblay, both of Richmond, Canada; Tommy Y. Meng, Lawrenceville, N.J.

[73] Assignee: FMC Corporation, Philadelphia, Pa.

[21] Appl. No.: 912,429

[22] Filed: Jul. 13, 1992

[30] Foreign Application Priority Data

Mar. 18, 1992 [CA] Canada ..... 2063351

[51] Int. Cl.[5] ..... D21C 3/04

[52] U.S. Cl. ..... 162/76; 162/78; 162/90; 162/19

[58] Field of Search ..... 162/19, 72, 76, 78, 162/80, 90

[56] References Cited

U.S. PATENT DOCUMENTS

| | | | |
|---|---|---|---|
| 4,239,643 | 12/1980 | Kowalski | 252/182 |
| 4,294,575 | 10/1981 | Kowalski | 8/111 |
| 4,311,553 | 1/1982 | Akerlund et al. | 162/23 |
| 4,486,267 | 12/1984 | Prusas | 162/25 |
| 4,599,138 | 7/1986 | Lindahl | 162/19 |
| 4,614,646 | 9/1986 | Christiansen | 423/272 |
| 4,732,650 | 3/1988 | Michalowski et al. | 162/17 |
| 4,734,160 | 3/1988 | Moldenius | 162/17 |
| 5,013,404 | 5/1991 | Christiansen et al. | 162/72 |
| 5,118,389 | 6/1992 | Dubelsten et al. | 162/78 |

FOREIGN PATENT DOCUMENTS

| | | |
|---|---|---|
| 0313478 | 4/1989 | European Pat. Off. . |
| 4915698 | 2/1974 | Japan . |

OTHER PUBLICATIONS

Lachenal et al., "Two Stage Peroxide Bleaching of Mech. Pulp" Pulp & Paper Canada, 1990, 91:6, pp. 145–149.

Kutney, G. W. "Hydrogen Peroxide: Stabilization of Bleaching Liquors", Pulp & Paper Canada, 1985, 86:12, pp. 182–189.

Suess, et al. "Substitution of Caustic Soda with Soda Ash in Peroxide Brightening of Mechanical Pulp", 1991 Pulping Conference, pp. 979–986.

Colodette et al., "The Effect of pH on Peroxide Brightening of Stoneground Pulp," 1989 Annual Meeting, TAPPI, pp. B45–B49.

Singh, *The Bleaching of Pulp,* Third Ed., TAPPI Press, 1953, pp. 211–233.

*Primary Examiner*—W. Gary Jones

*Assistant Examiner*—Dean Tan Nguyen

*Attorney, Agent, or Firm*—R. E. Elden; P. C. Baker; R. L. Andersen

[57] ABSTRACT

A process is provided for peroxygen bleaching of high yield pulp in which sodium carbonate replaces sodium hydroxide and sodium silicate. The process employs a chelating agent as a substitute for the silicate normally required so that the process can operate as a closed cycle system.

10 Claims, No Drawings

PROCESS FOR PEROXIDE BLEACHING OF MECHANICAL PULP USING SODIUM CARBONATE AND NON-SILICATE CHELATING AGENTS

This invention is a process for bleaching hardwood pulp with a peroxygen-soda ash solution in the absence of silicates.

Bleaching mechanical and high yield-pulps with hydrogen peroxide is well known technology, having been practiced industrially for many years.

Hydrogen peroxide is susceptible to catalytic decomposition by heavy metallic ions and enzymes: its stability tends to decrease with increasing alkalinity. It is necessary to adjust and maintain pH at a level which permits effective bleaching and at the same time minimizes decomposition. Thus, peroxide solutions must be buffered and stabilized. The most common buffer is sodium silicate, which is also capable of acting as a stabilizer. Usually a small amount of magnesium ion is added to form a colloidal suspension of magnesium silicate, which is believed to inactivate the metallic catalysts by adsorption.

The present trend is toward high-yield pulps with a higher increase of brightness (20 to 25 points) and toward minimizing the environmental impact of pulp mills by total recycle of process water (zero liquid effluent). However, it has been found that recycle of process water containing sodium silicate can result in an intolerable buildup of silica scale. Consequently, attempts have been made to avoid adding sodium silicate to the process bleach liquor.

Chelating agents have long been recognized to be useful for stabilizing solutions containing hydrogen peroxide. For example, in U.S. Pat. No. 3,860,391 the bleaching of cellulose textile fibers and mixtures with synthetic fibers is accomplished by employing peroxide in a silicate-free system in the presence of an aliphatic hydroxy compound, an amino alkylenephosphonic acid compound and, alternatively, with the addition of a polyaminocarboxylic acid erythritol.

Other more recent U.S. patents employ such phosphonates as indicated above, but in a peroxide bleaching system, include U.S. Pat. No. 4,239,643 and its divisional U.S. Pat. No. 4,294,575.

While combinations of chelating agents are useful in stabilizing peroxide bleaching systems, iron, manganese and copper are catalysts for the decomposition of the peroxide and their presence also reduces the brightness of finished mechanical pulps according to U.S. Pat. No. 4,732,650. While the chelants might be expected to tie up minor amounts of the metal ions, the presence of significant amounts of magnesium and/or calcium ions tends to overwhelm the ability of the chelants to complex the iron, manganese and copper ions present.

Certain combinations of the aminophosphonic acids together with polycarboxylic acids or polycarboxylic amides or a sulfonic acid derivative of a polyamide have been found to provide stabilization in the presence of significant amounts of magnesium and/or calcium ions according to U.S. Pat. No. 4,614,646.

U.S. Pat. No. 4,732,650 teaches a two-step silica-free peroxygen bleach process employing steps of contacting the pulp with (1) a polyaminocarboxylic acid prior to or in the deckering or dewatering step followed by (2) a peroxide solution together with the stabilizing components; an aminophosphonic acid chelant and a polymer of an unsaturated carboxylic acid or amide (optionally substituted with an alkylsulfonic acid group).

Although these "silicate replacements" are effective in stabilizing hydrogen peroxide bleach liquor, they do not address the buffering property of sodium silicate, particularly for mechanical and high-yield pulps. The bleach liquor must be sufficiently alkaline to maintain an adequate concentration of perhydroxyl ions but not so alkaline as to cause excessive peroxide decomposition. For such pulps an optimum balance is particularly important because the oxidative reactions produce alkali-consuming acidic functional groups, and the lignin and extractives are susceptible to attack by both alkali and free oxygen. If insufficient alkali is present, the pH may fall to the point where bleaching ceases. Alternatively, if the alkali concentration is too high peroxide decomposition may occur.

The alkalinity of bleach liquor is provided by sodium silicate and caustic soda. Commercial "42° Baume" sodium silicate contains approximately 11.5% by weight of free NaOH. Typically 3% to 6% by weight of sodium silicate is employed, on the basis of the dry weight on pulp to provide part of the alkalinity and to buffer the bleach solution. Additional alkalinity is provided by adding free caustic soda (sodium hydroxide). However, the price and availability of caustic soda makes an alternative, such as sodium carbonate, economically and environmentally attractive.

Suess et al. at the TAPPI 1991 Pulping Conference (pp. 979–986) disclosed that a sodium carbonate-sodium silicate system could replace a sodium hydroxide-sodium silicate system at low hydrogen peroxide application rates (1 to 2% $H_2O_2$) for bleaching mechanical pulp. However, it was disclosed that at higher hydrogen peroxide application rates (above 2%) pulp bleached with sodium carbonate as the alkali was 1 point lower in brightness than the pulp bleached with sodium hydroxide. In either case, sodium silicate was considered a significant factor in the brightening process, although partial substitution of sodium silicate with sodium carbonate was thought possible.

The present invention overcomes the problems of the prior art to provide a process for increasing the brightness of mechanical and high-yield hardwood pulp comprising (a) incorporating sufficient hardwood pulp into a silicate-free bleach solution to provide a consistency of about 5% to about 45%, the bleach solution consisting essentially of about 2% to about 6% by weight sodium carbonate on an oven dry basis of the pulp, about 0.2% to about 0.6% by weight silicate substitute on an oven dry basis of the pulp and about 2% to about 7% by weight hydrogen peroxide on an oven dry basis of the pulp, (b) maintaining the bleach solution at a temperature of about 35° C. to about 70° C. for about 2 to about 6 hours, and (c) separating the pulp from at least part of the bleach solution thereby providing a bleached pulp and a residual bleach solution.

For the purpose of this invention silicate-free shall refer to a pulp bleach stage or solution containing about 2% to about 6% sodium carbonate, about 0.2% to about 0.6% silicate substitute and about 2% to about 7% hydrogen peroxide based on the oven dry weight of the pulp, but shall contain substantially no sodium silicate or sodium hydroxide. The silicate-free solution may contain surfactants and other adjuvants.

The term "silicate substitute" is defined to include organic chelating agents alone, as mixtures of two or more chelating agents or as mixtures of chelating agents with polyhydroxy compounds or oligomers or polymers of hydroxy and carboxy compounds as disclosed in U.S. Pat. No. 4,732,650. Chelating agents include such compounds as polycarboxylic acids, diethylenepentaacetic acid (DTPA); phosphonic acids, such as 1-hydroxyethylidene-1,1-diphosphonic acid; aminophosphonic acids such as ethylenediaminetetra(-phosphonic acid); and aminocarboxylic acids, such as nitrillotriacetic acid (NTA) and ethylenediaminetetraacetic acid (EDTA). Other constituents of silicate substitutes may include pentaerythritol, erythritol, polyamino-carboxylic acids or salts. For example, U.S. Pat. No. 4,732,650 teaches as a silicate substitute a combination of an aminophosphonic acid chelant or salt thereof and at least one polymer of (i) an unsaturated carboxylic acid or salt thereof, (ii) an unsaturated carboxylic amide or (iii) an unsaturated carboxylic amide wherein the amide hydrogens are substituted with an alkylsulfonic acid group or salt thereof.

The pulp may be any high-yield or mechanical hardwood pulp. Hardwoods are generally considered to be dicotyledons as opposed to softwoods (monocotyledons). Particularly desirable hardwoods include, but are not limited to, aspen, cottonwood, maple, alder and the like. "High-yield pulp" for the purpose of this invention will be synonymous with mechanical and high-yield pulp which generally includes pulp containing a large proportion (80% to 100%) of the lignin originally contained in the wood. Such pulp includes groundwood pulp, refiner pulp, thermomechanical pulp (TMP), high yield sulfite pulp (HYS) and chemothermomechanical pulp (CTMP). Any convenient pulp consistency may be employed. Up to about 45% is generally the maximum practical and a consistency of less than 5% is generally uneconomic.

The process of the invention may be practiced as a single stage of bleaching using either unbleached pulp as feed, or by using previously bleached high-yield pulp as feed. Clearly, it could be used in two successive stages in which hardwood pulp is bleached in a first stage and subsequently bleached in a second silica-free bleach stage to a high brightness. The residual bleach solution from the first (or second) stage may be incorporated as part of the make-up of either the first stage or second stage bleach solution.

The brightness of pulp is a well known measure of reflectance, however, there are at least three different scales; ISO, Elrepho and GE. The difference of brightness of these scales is about the same.

Sodium carbonate is well recognized as a source of an alkali and is often an alternative for sodium hydroxide. However, until now it has never been possible to substitute sodium carbonate (soda ash) for sodium hydroxide (caustic soda) in peroxygen bleaching stages. Surprisingly, it has been found that hydrogen peroxide bleaching systems using only sodium carbonate and silicate substitutes can totally replace conventional bleaching systems using sodium hydroxide and sodium silicate. Although the present examples employed commercial "natural" sodium carbonate it is clear that Solvay type or recovered sodium carbonate could be equally effective.

Earlier work by Suess et al. (TAPPI 1991 Pulping Conference) on softwood mechanical/high-yield pulps had shown that only partial substitution of caustic was effective because of lowered bleaching efficiency. The present work demonstrates that silicate-free bleaching using sodium carbonate as the only alkali source can achieve equivalent brightness gains as that involving caustic soda and sodium silicate. Further, it was found unexpectedly that bleaching efficiency versus 100% caustic soda was improved remarkably (demonstrated by much higher peroxide residuals). In addition to chemical savings potential for both alkali and peroxide, peroxide bleaching with soda ash offers the following potential advantages:

Final pH is not as high as during bleaching using caustic soda, increasing thickening efficiency after brightening and lowering demand for neutralization chemicals.

While bleaching to the same final brightness, scattering coefficient and resulting opacity are higher than those seen when using caustic soda.

As seen from the following examples the present process is distinguished over the prior art in that it is more efficient in terms of peroxide consumption to achieve a large brightness gain than standard bleaching using NaOH, silicate and $MgSO_4$. In addition, bleaching with soda ash and peroxide lowers bleaching costs in the future as caustic soda becomes less plentiful and more expensive. Finally, it is wholly unexpected that sodium carbonate could eliminate sodium silicate as a buffer to control pH during bleaching, the major role that silicate plays according to the prior art. Unexpectedly, it was found that sodium carbonate is not necessarily added to achieve equivalent alkali as a near optimal bleach involving caustic soda only. However, sodium carbonate is not a replacement for caustic soda on an equivalent active alkali basis. Instead it was found that its proper ratio to hydrogen peroxide must be determined on an equivalent basis as demonstrated by the following examples.

A series of experiments were run simulating both a first and second stage bleach using high-yield aspen CTMP. The bleaching conditions and analytical results of each run are presented in the following Tables. Initial and final ISO brightness were measured. The samples are arranged in the tables to better illustrate the conclusions which can be reached from the data.

Total alkalinity (as NaOH) was determined by titration with standard acid using phenophthalien as an indicator.

EXAMPLES

Two-Stage Bleach

Runs 25 and 27 of Table I show that in a two-stage hydrogen peroxide bleach sequence, a final brightness of 85.5% ISO can be reached starting with a 59% ISO unbleached brightness (26.5% ISO gain). First stage (Run 25) peroxide addition is 2.7% on OD pulp, the alkali (100% soda ash) ratio to peroxide is 1.2:1, no silicate or magnesium sulphate is added, only 0.5% XUS-11082 ® on OD pulp (Dow's organic silicate replacement product). Second stage (Run 27) peroxide addition is 5.0% on OD pulp, the alkali (100% soda ash) ratio to peroxide is 0.75:1 and again no silicate or magnesium sulphate is added, only 0.5% XUS-11082 on OD pulp. In this bleach sequence, residual peroxide from stage 2 was 3.0% on OD pulp after five hours of bleaching at 60° C., while residual peroxide from stage 1 was 1.65% on OD pulp after four hours of bleaching. Therefore, a total of 3.05% peroxide on pulp was required to gain 26.5 points of brightness, an average of 8.7 points gained per percent peroxide. Commercially, it is known that 4.0–5.0% peroxide applied on pulp in a two stage bleaching process is required to reach a final brightness of 85% ISO.

Soda Ash vs. Caustic Soda

Samples 29 and 30 of Table I and 29B and 30B of Table II demonstrate that bleaching with soda ash is more efficient than bleaching with sodium hydroxide as the active alkali. Comparative bleaches on the same pulp that had been laboratory refined down to a freeness of 170 CSF from 600 CSF show the following results: First stage bleaching increases brightness from 59.5% ISO to 77.8% ISO after 4 hours with a peroxide charge of 2.7% on pulp and a soda ash charge of 3.5% on pulp, an alkali to peroxide ratio of 1.3:1 (Sample 29). Residual peroxide was 1.47% on OD pulp. A comparative bleach (Run 30) with 2.7% peroxide and 2.2% caustic soda (alkali to peroxide ratio of 0.8:1 gave a brightness after 3.5 hours of 77% ISO but a peroxide residual of only 0.7% on OD pulp (Samples 29 and 30 in Table I). Second stage bleaches of these samples, with 5.0% $H_2O_2$ on OD pulp and respectively 100% soda ash and 100% caustic soda, yielded final brightnesses of 82.6–82.7% ISO (Table II, Samples 29B and 30B). Again, however, after 4 hours of bleaching at 60° C., peroxide residual values were much higher when bleaching with soda ash versus caustic soda (2.27% vs. 1.05% on OD pulp).

Effect of Silicate

Contrary to alkaline peroxide bleaching using caustic soda as the alkali, the addition of sodium silicate during alkaline peroxide bleaching with 100% soda ash actually lowers final brightness and reduces peroxide residual. This important information was certainly unexpected, and was not recognized in previous work on softwood mechanical/high-yield pulps. (Compare Samples 25 to 25R (1st stage) and Samples 27 to 27R (2nd stage). Notice in each case that pH after 4 hours is essentially the same when bleaching with and without silicate, so a change in pH causing less than optimal bleaching conditions cannot be the explanation for this.

Single-Stage High Consistency

Single-stage bleaching at higher consistency is more efficient when using 100% soda carbonate as the alkali source, but the degree of improvement is perhaps greater than what would be expected based on experience in bleaching with caustic soda as the alkali (Table I, Sample 26 vs. Table II, Sample 26R). The difference in brightness after 4 hours of bleaching with a 2.7% peroxide addition at 12% versus 30% consistency is 77% ISO compared to 82% ISO.

Effect of Magnesium Sulfate

Magnesium sulfate is used to minimize peroxide decomposition in a caustic soda system. In a 100% sodium carbonate system, the opposite was found to be true. (Table III, Samples 8 and 9 versus 10, 4 hr. agitated values). The data in Tables III and IV compare peroxide stability over a period of up to 24 hours using various additives including magnesium sulphate, sodium silicate and organic silicate replacements such as DTPA, XUS-11082 (Dow Chemical), SFP (High Point Chemical), Questal, N.J. (Clough Chemical) and products by WR Grace and Monsanto. Sample 13 demonstrates the poor performance of sodium silicate. In comparison, most if not all of the organic products, including DTPA, appear to offer good stability protection in a soda ash, peroxide bleaching system.

Bleaching Efficacy

Bleaching efficiency was found to be decreased when caustic soda and sodium carbonate are combined either in the same stage or in two successive stages. Two-stage bleaching using first stage bleached pulp that had been thickened and sent from a commercial mill (alkali used was caustic soda of course) is demonstrated in Tables V and VI. First stage brightness was 78.8% ISO as recorded, and Samples 8 and 9 bracketed the alkali charge used by the mill (caustic soda) in Sample 7 during a second stage bleach where the applied peroxide charge was 7.5% on OD pulp. As seen, after 4 hours the caustic soda bleach provided a final brightness of 87.2% ISO while brightness was actually decreased during bleaching with soda ash. It was quite clear from the peroxide and alkali residuals that the alkali to peroxide ratio needed to be lowered to be successful. Samples 10–14 indicate that only 0.75% sodium carbonate on OD pulp is required to reach an 84.7% ISO brightness, leaving a peroxide residual of 4.6%. However, compared to a bleach using caustic soda (Sample 15), final brightness is lacking. Samples 16–22 (Table VI) examine first stage bleaching using 2.7% peroxide on pulp and sodium carbonate addition optimization, and demonstrate that once caustic soda is not employed the ratio of alkali to peroxide needs to be brought up once again to achieve the best brightness levels and consume peroxide residuals.

Optical and Physical Properties

Key optical and physical properties were determined using standard TAPPI procedures on unbleached aspen CTMP along with some of this pulp bleached in the laboratory with one and two stages of peroxide, having caustic soda as the alkali versus sodium carbonate. Results are summarized in Table VII. The results show the expected lower breaking length and burst when bleaching with soda ash versus caustic soda, but also the expected higher scattering coefficient and printing opacity at essentially the same brightness. Although less strength development during peroxide bleaching with soda ash is a disadvantage of the process, similar strength gains could probably be gained earlier during refining by impregnating chips at a higher pH through the use of more caustic soda.

Effect of Temperature

The effect of increasing temperature from 60° C. to 75° C. is shown by comparing Samples 25C and 25C5 in Table VII to Samples 25 and 27 in Table I. Brightness gain was not accelerated over the four hour time period and the final brightness after two stages of bleaching was no higher at the higher temperature. Instead of temperature, retention time appears to be the most important consideration in optimizing bleaching efficiency when using peroxide and soda ash.

TABLE I

PULP BLEACHING AT 60° C.
$Na_2CO_3$ AS A REPLACEMENT FOR NaOH

| Sample | 25 | 26 | 27 | 29 | 30 |
|---|---|---|---|---|---|
| Stage | 1 | 1 | 2 | 1 | 1 |
| Solution Makeup | | | | | |
| $H_2O_2$ % | 2.70 | 2.70 | 5.00 | 2.70 | 2.70 |
| $Na_2CO_3$ % | 3.24 | 3.78 | 3.75 | 3.50 | 2.21 |
| Sil. Sub. % | 0.50 | 0.50 | 0.50 | 0.50 | 0.50 |
| $MgSO_4$ % | 0 | 0 | 0 | 0 | 0.06 |
| Pulp | | | | | |
| ISO % | 59.0 | 59.0 | 77.8 | 59.5 | 59.5 |
| Consist. % | 12.0 | 12.0 | 29.4 | 12.0 | 12.0 |
| Freeness | 600 | 600 | 600 | 165 | 165 |
| Slurry Init. | | | | | |
| pH | 10.3 | 10.5 | 10.1 | 10.6 | 11.8 |
| $H_2O_2$ % | 2.41 | 2.07 | 5.20 | 2.74 | 2.26 |
| Total Alk. % | 0.70 | 0.82 | 1.20 | 1.14 | 1.40 |
| After 2 Hr. | | | | | |
| pH | 8.7 | 8.7 | 9.4 | 8.8 | 8.1[2] |
| $H_2O_2$ % | 1.84 | 1.50 | 3.53 | 1.50 | 0.70 |
| Total Alk. % | 0.0 | 0.0 | 0.29 | 0.0 | 0.0 |
| ISO % | 75.5 | 75.8 | 84.2 | 76.2 | 75.7 |
| After 4 Hr. | | | | | |
| pH | 8.5 | 8.5 | 9.6[3] | 8.1 | 7.9[4] |
| $H_2O_2$ % | 1.65 | 1.42 | 3.01 | 1.47 | 0.70 |
| Total Alk. % | 0.0 | 0.0 | 0.24 | 0.0 | 0.0 |
| ISO % | 77.0 | 77.2 | 85.6 | 77.8 | 77.0 |

[1]2.2% NaOH
[2]1 hour
[3]5 hours
[4]3.5 hours

TABLE II

PULP BLEACHING AT 60° C.
$Na_2CO_3$ AS A REPLACEMENT FOR NaOH AND SILICATE

| Sample | 29B | 30B | 25RS | 27RS | 27RST |
|---|---|---|---|---|---|
| Solution Makeup | | | | | |
| $H_2O_2$ % | 5.00 | 5.00 | 2.70 | 5.00 | 2.70 |
| $Na_2CO_3$ % | 4.25 | 2.60* | 3.24 | 3.75 | 3.78 |
| Sil. Sub. % | 0.50 | 0.50 | 1.5[5] | 1.5[5] | 0.50 |
| $MgSO_4$ | 0.0 | 0.06 | 0.0 | 0.0 | 0.0 |
| Pulp | | | | | |
| ISO % | 77.8 | 77.0 | 59.0 | 75.0 | 59.0 |
| Consist. % | 31.4 | 32.3 | 12.0 | 31.7 | 30.8 |
| Freeness | 170 | 170 | 600 | 600 | 600 |
| Slurry Init. | | | | | |
| pH | 10.3 | 11.7 | 10.6 | 10.4 | 10.2 |
| $H_2O_2$ % | 4.94 | 3.61 | 3.06 | 3.95 | 1.99 |
| Total Alk. % | 0.70 | 0.82 | 1.20 | 1.41 | 1.40 |
| After 2 Hr. | | | | | |
| pH | 9.5 | 9.7 | 8.8 | 9.6 | 9.4 |
| $H_2O_2$ % | 2.84 | 1.24 | 1.57 | 1.56 | 0.96 |
| Total Alk. % | NA | NA | 0.12 | 0.34 | 0.35 |
| ISO % | 81.7 | 82.2 | 73.2 | 83.1 | 80.0 |
| After 4 Hr. | | | | | |
| pH | 9.5 | 9.6 | 8.3 | 9.5 | 9.3 |
| $H_2O_2$ % | 2.27 | 1.05 | 1.39 | 0.95 | 0.69 |
| Total Alk. % | 0.30 | 0.21 | tr | 0.34 | 0.09 |
| ISO % | 82.7 | 82.6 | 75.0 | 84.3 | 82.0 |

* = 2.60% NaOH
[5] = 1.5% 42° Baume Sodium Silicate
NA = Not Available
tr = Trace

TABLE III

4 HOUR STABILITY OF BLEACH SOLUTION CONTAINING 13 g $H_2O_2$ AND 3.8 g $Na_2CO_3$/100 ml PLUS SILICATE SUBSTITUTES WITH AND WITHOUT AGITATION AT 20° C.

| Sample | Liquor Composition g/100 ml $H_2O_2$, $NaCO_3$ plus | $H_2O_2$ Assay After Init. | 2 Hr. | 4 Hr. | 4 Hr. ag. |
|---|---|---|---|---|---|
| 5 | .64 g DTPA*<br>.1 g $MgSO_4$ | 70.0 | 62.0 | 52.4 | 55.9 |

TABLE III-continued

4 HOUR STABILITY OF BLEACH SOLUTION CONTAINING 13 g $H_2O_2$ AND 3.8 g $Na_2CO_3$/100 ml PLUS SILICATE SUBSTITUTES WITH AND WITHOUT AGITATION AT 20° C.

| Sample | Liquor Composition g/100 ml $H_2O_2$, $NaCO_3$ plus | $H_2O_2$ Assay After Init. | 2 Hr. | 4 Hr. | 4 Hr. ag. |
|---|---|---|---|---|---|
| 6 | .64 g XUS*<br>.1 g $mgSO_4$ | 70.0 | 68.2 | 66.6 | 63.2 |
| 7 | .64 g SFP*<br>.1 g $MgSO_4$ | 70.2 | 61.9 | 47.6 | 48.5 |
| 8 | .1 g $MgSO_4$ | 69.4 | 60.5 | 48.5 | 43.9 |
| 9 | .5 g $MgSO_4$ | 69.0 | 59.0 | 48.5 | 43.9 |
| 10 | Control | 67.8 | 64.8 | 48.8 | 47.9 |

*DTPA = diethylenetriamine pentaacetic acid
XUS = Dow Chemical Co. XUS-11082 ® organic silica substitute
SFP = High Point Chemical Co. SFP ® organic silicate substitute

TABLE IV

24 HOUR STABILITY OF BLEACH SOLUTION CONTAINING 13 g/l $H_2O_2$, SODA ASH AND SILICATE SUBSTITUTE AT 20° C.

| Sample | Liquor Composition g/100 ml $H_2O_2$ Plus | $H_2O_2$ Assay After Init. | 4 Hr. | 24 Hr. |
|---|---|---|---|---|
| 11 | 4.5 g $Na_2CO_3$<br>.8 g GRA* | 64.8 | 60.7 | 45.7 |
| 12 | 4.5 g $Na_2CO_3$<br>.8 g MON* | 64.4 | 62.1 | 46.9 |
| 13 | 7.8 g $Na_2CO_3$<br>3.57 g NaSIL* | 66.0 | 44.2** | 12.9 |
| 14 | 4.5 g $Na_2CO_3$<br>.8 g QU* | 65.4 | 61.0 | 50.2 |

*GRA = WR Grace organic silicate substitute
MON = Monsanto Corp. organic silicate
NaSIL = 42° Baume sodium silicate
QU = Clough Chemical Co., Questal NJ - organic silicate substitute

TABLE V

PULP BLEACHING AT 60° C. $Na_2CO_3$ AS A REPLACEMENT FOR NaOH

| Sample | 7 | 8 | 9 | 10 | 11 | 12 |
|---|---|---|---|---|---|---|
| Solution Makeup | | | | | | |
| $H_2O_2$ % | 7.50 | 7.50 | 4.50 | 7.50 | 7.50 | 7.50 |
| $Na_2CO_3$ % | 4.68* | 5.70 | 3.42 | 3.75 | 1.50 | 1.50 |
| Sil. Sub. % | 0.0 | 0.0 | 0.0 | 0.50 | 0.50 | 0.0 |
| $MgSO_4$ | 0.10 | 0.10 | 0.10 | 0.10 | 0.0 | 0.0 |
| Pulp | | | | | | |
| ISO % | 78.8 | 78.8 | 78.8 | 78.8 | 78.8 | 78.8 |
| Consist. % | 42.0 | 42.0 | 42.0 | 42.0 | 42.0 | 42.0 |
| Slurry Init. | | | | | | |
| pH | 11.8 | 10.6 | 10.5 | 10.1 | 9.8 | 9.8 |
| $H_2O_2$ % | 6.38 | 6.82 | 4.13 | 7.36 | 8.08 | NA |
| Total Alk. % | 3.70 | 5.76 | 3.70 | 1.28 | 0.51 | NA |
| After 2 Hr. | | | | | | |
| pH | NA | NA | NA | 10.3 | 9.8 | 9.9 |
| $H_2O_2$ % | | | | NA | 0.88 | 0.07 |
| Total Alk. % | NA | NA | NA | 1.07 | 0.26 | 0.26 |
| ISO % | NA | NA | NA | 81.0 | 82.8 | 80.6 |
| After 4 Hr. | | | | | | |
| pH | 11.6 | 10.6 | 10.6 | NA | 9.9 | 9.9 |
| $H_2O_2$ % | 1.09 | 0.0 | 0.9 | NA | 0.28 | 0.0 |
| Total Alk. % | 1.54 | 5.00 | 3.35 | NA | 0.26 | 0.26 |
| ISO % | 87.2 | 74.0 | 75.3 | NA | 83.1 | 80.5 |

* = 4.68% NaOH
NA = Not Available

TABLE VI

PULP BLEACHING AT 60° C. $Na_2CO_3$ AS A REPLACEMENT FOR NaOH AND SODIUM SILICATE

| SAMPLE | 13 | 14 | 15 | 16 | 19 | 20 | 22 |
|---|---|---|---|---|---|---|---|
| Solution Makeup | | | | | | | |
| $H_2O_2$ % | 7.50 | 7.50 | 5.30 | 3.20 | 2.70 | 2.70 | 2.70 |

TABLE VI-continued

PULP BLEACHING AT 60° C. $Na_2CO_3$ AS A REPLACEMENT FOR NaOH AND SODIUM SILICATE

| SAMPLE | 13 | 14 | 15 | 16 | 19 | 20 | 22 |
|---|---|---|---|---|---|---|---|
| $Na_2CO_3$ % | 0.75 | 0.75 | 2.70* | 0.78 | 1.10 | 1.54 | 2.70 |
| Sil. Sub. % | 0.50 | 1.5[s] | 0.20 | 0.50 | 0.50 | 0.50 | 0.50 |
| $MgSo_4$ | 0.0 | 0.0 | 0.08 | 0.0 | 0.0 | 0.0 | 0.0 |
| Pulp | | | | | | | |
| ISO % | 78.8 | 78.8 | 78.8 | 59.0 | 59.0 | 59.0 | 59.0 |
| Consist. % | 42.0 | 42.0 | 42.0 | 35.8 | 35.8 | 35.8 | 35.8 |
| Slurry Init. | | | | | | | |
| pH | 9.4 | 9.8 | 11.5 | 9.3 | 9.8 | 9.9 | 10.2 |
| $H_2O_2$ % | 7.30 | 6.28 | 4.81 | 3.20 | 2.60 | NA | 2.44 |
| Total Alk. % | 0.21 | 0.41 | 2.98 | 0.0 | 0.12 | 0.23 | 0.59 |
| After 2 Hr. | | | | | | | |
| pH | 9.1 | 9.4 | 11.0 | 7.6 | 7.8 | 7.9 | 8.5 |
| $H_2O_2$ % | 5.68 | 4.92 | 2.79 | 2.99 | 2.32 | 1.84 | 1.89 |
| Total Alk. % | 0.10 | 0.10 | 0.19 | 0.00 | 0.00 | 0.00 | 0.00 |
| ISO % | 83.2 | 83.3 | 85.1 | 69.3 | 70.6 | 71.3 | 74.7 |
| After 4 Hr. | | | | | | | |
| pH | 9.1 | 9.2 | 10.6 | 7.1 | 7.5 | 7.8 | 8.3 |
| $H_2O_2$ % | 4.59 | 4.95 | 1.64 | 2.94 | 2.30 | 1.94 | 1.77 |
| Total Alk. % | 0.05 | 0.05 | 0.82 | 0.0 | 0.0 | 0.0 | 0.0 |
| ISO % | 84.7 | 84.3 | 86.7 | 71.3 | 72.4 | 73.8 | 76.5 |

* = 2.70% NaOH
s = 1.5% sodium silicate
NA = Not Available

TABLE VII

COMPARISON OF OPTICAL AND PHYSICAL PROPERTIES

| Sample | Unbleached (Control) | 31 | 29B | 30B |
|---|---|---|---|---|
| Stage | | 1 Soda Ash | 2 Soda Ash | 2 NaOH |
| Caliper Mills | 4.95 | 4.96 | 4.32 | 3.69 |
| Tear 4 sheets | 4 | 4.4 | 6.1 | 6.1 |
| Tensile Nwt. | 26.5 | 30.7 | 32.8 | 41.6 |
| Mullen | 9.1 | 10.9 | 12.4 | 16 |
| Wet Weight 4 shts. | 5.022 | 5.35 | 5.087 | 4.94 |
| Dry Weight 4 shts. | 4.605 | 4.912 | 4.625 | 4.549 |
| % OD on testing | 9.06 | 8.92 | 9.99 | 8.60 |
| Basis Weight gms/m2 | 57.56 | 61.40 | 57.81 | 56.86 |
| Freeness | 165 | 175 | 170 | 170 |
| Specific Volume cc/gm | 2.18 | 2.05 | 1.90 | 1.65 |
| Breaking Length, Meters | 3130 | 3400 | 3857 | 4974 |
| Burst Factor | 11.11 | 12.48 | 15.08 | 19.78 |
| Tear Factor | 27.80 | 28.66 | 42.21 | 42.91 |
| Brightness | 62.1 | 78.7 | 81.8 | 82.3 |
| Printing Opacity | 91.3 | 84.4 | 79.4 | 76.5 |
| Scattering Coefficient | 51.8 | 47.8 | 42.2 | 37.9 |
| Absorb. Coefficient | 2.1 | 0.52 | 0.35 | 0.3 |

TABLE VIII

PULP BLEACHING AT 75° C. $Na_2CO_3$ AS A REPLACEMENT FOR NaOH

| Sample | 25C | 25D | 25E | 25C5 | 25C4 | 25C3 |
|---|---|---|---|---|---|---|
| Solution Makeup | | | | | | |
| $H_2O_2$ % | 2.70 | 2.00 | 1.50 | 5.00 | 4.00 | 3.00 |
| $Na_2CO_3$ % | 3.20 | 2.40 | 1.80 | 4.25 | 4.00 | 3.60 |
| Sil. Sub. % | 0.50 | 0.50 | 0.50 | 0.50 | 0.50 | 0.50 |
| Pulp | | | | | | |
| ISO % | 59.0 | 59.0 | 59.0 | 77.7 | 77.7 | 77.7 |
| Consist. % | 12.0 | 12.0 | 12.0 | 28.6 | 29.3 | 31.0 |
| Freeness | 600 | 600 | 600 | 600 | 600 | 600 |
| Slurry Init. | | | | | | |
| pH | 10.3 | 10.2 | 10.1 | 10.4 | 10.4 | 10.4 |
| $H_2O_2$ % | 2.54 | 1.79 | 1.30 | 5.20 | 4.50 | 3.30 |
| Total Alk. % | 0.82 | 0.59 | 0.35 | 1.69 | 1.59 | 1.47 |

TABLE VIII-continued

PULP BLEACHING AT 75° C. $Na_2CO_3$ AS A REPLACEMENT FOR NaOH

| Sample | 25C | 25D | 25E | 25C5 | 25C4 | 25C3 |
|---|---|---|---|---|---|---|
| After 2 Hr. | | | | | | |
| pH | 8.3 | 8.4 | 8.4 | 9.7 | 9.7 | 9.6 |
| $H_2O_2$ % | 1.75 | 1.30 | 0.95 | 2.55 | 2.09 | 1.32 |
| Total Alk. % | tr | tr | 0.0 | 0.25 | 0.24 | 0.23 |
| ISO % | 76.1 | 73.5 | 70.2 | 82.3 | 82.4 | 81.7 |
| After 4 Hr. | | | | | | |
| pH | 8.6 | 8.2 | 8.3 | 9.5 | 9.6 | 9.5 |
| $H_2O_2$ % | 1.62 | 1.10 | 0.77 | 2.10 | 1.58 | 1.00 |
| Total Alk. % | tr | 0.0 | 0.0 | 0.15 | 0.14 | 0.13 |
| ISO % | 77.7 | 75.5 | 72.7 | 84.6 | 84.3 | 83.4 |

tr = trace

We claim:

1. A process for brightening mechanical and high yield hardwood pulp substantially free of silicate and caustic soda to produce a brightened pulp of brightness substantially equivalent to that obtained using the equivalent amount of peroxide in a silicate and caustic soda bleaching liquor comprising:

(a) incorporating hardwood pulp into a silicate-free bleach solution to provide a consistency of about 5% to 45%, the bleach solution consisting essentially of about 2% to about 6% by weight sodium carbonate on an oven dry basis of pulp, about 0.2% to about 0.6% by weight silicate substitute selected from the group consisting of organic chelating agents, polyhydroxy compounds, and oligomers and polymers of hydroxy and carboxy compounds and mixtures thereof, and about 2% to about 7% by weight hydrogen peroxide on the oven dry basis of the pulp, (b) maintaining the bleach solution at a temperature of about 35° C. to about 70° C. for about 2 to about 6 hours, and (c) separating the pulp from at least part of the bleach solution thereby providing a bleached pulp and a residual solution.

2. The process of claim 1 wherein sufficient unbleached pulp is incorporated into the bleach solution to provide a consistency of about 11 to 14%, and the bleach solution comprises about 3% to about 4% sodium carbonate, about 0.3% to about 0.6% silicate substitute and about 2.5% to about 3.5% hydrogen peroxide.

3. The process of claim 1 wherein the pulp has been bleached and is incorporated into the bleach solution at a consistency of about 25% to about 45%, and the bleach solution comprises about 3% to about 4% sodium carbonate, about 0.3% to about 0.6% silicate substitute, and about 4% to about 6% hydrogen peroxide.

4. The process of claim 1 wherein the bleached pulp from step(c) is incorporated into a second stage bleach solution at a consistency of about 25% to about 45%, the second stage bleach solution comprising about 3% to about 4% sodium carbonate, about 0.3% to about 0.6% silicate substitute, and about 4% to about 6% hydrogen peroxide and is subjected to the further steps of maintaining the second stage bleach solution at a temperature of about 35° C. to about 70° C. for about 2 to about 6 hours, and separating the pulp from at least part of the second stage bleach solution thereby providing a second stage bleached pulp and a second stage residual solution.

5. A process for brightening mechanical and high yield hardwood pulp substantially free of silicate and caustic soda to produce a brightened pulp of brightness substantially equivalent to that obtained using the equivalent amount of peroxide in a silicate and caustic soda bleaching liquor comprising:

(a) incorporating hardwood pulp into a silicate-free, first stage bleach solution to provide a consistency of about 5% to 14%, the first stage bleach solution comprising about 2% to about 6% by weight sodium carbonate, about 0.2% to about 0.6% by weight silicate substitute selected from the group consisting or organic chelating agents, polyhydroxy compounds, and oligomers and polymers of hydroxy and carboxy compounds and mixtures thereof, and about 2% to about 7% by weight hydrogen peroxide on an oven dry basis of the pulp, (b) maintaining the first stage bleach solution at a temperature of about 35° C. to about 70° C. for about 2 to about 6 hours, (c) separating the pulp from at least part of the first stage bleach solution thereby providing a bleached pulp and a first stage residual solution, (d) incorporating the bleached pulp into a second stage bleach solution at a consistency of about 25% to about 45%, the second stage bleach solution comprising about 3% to about 4% sodium carbonate, about 0.3% to about 0.6% silicate substitute, and about 4% to about 6% hydrogen peroxide, (e) maintaining the second stage bleach solution at a temperature of about 35° C. to about 70° C. for about 2 to about 6 hours, (f) separating the pulp from at least part of the second stage bleach solution thereby providing a second stage bleached pulp and a second stage residual solution.

6. The process of claim 5 wherein the first stage residual solution is incorporated into the first stage bleach solution in step (a).

7. The process of claim 5 wherein the second stage residual solution is incorporated into the first stage bleach solution in step (a).

8. The process of claim 5 wherein the first stage residual solution is incorporated into the second stage bleach solution in step (d).

9. The process of claim 5 wherein the second stage residual solution is incorporated into the second stage bleach solution in step (d).

10. The process of claim 5 wherein the first stage residual solution is incorporated into first stage bleach solution in step (a) and wherein the second stage residual solution is incorporated into the second stage bleach solution in step (d).

* * * * *

UNITED STATES PATENT AND TRADEMARK OFFICE

CERTIFICATE OF CORRECTION

PATENT NO. : 5,248,389

DATED : September 28, 1993

INVENTOR(S) : Heimburger et al

It is certified that error appears in the above-identified patent and that said Letters Patent is hereby corrected as shown below:

Column 8, line 57, Table V, Column heading 9, $H_2O_2$% in sub-heading After 4Hr. reads "0.9" instead of --0.0--.

Column 11, line 13, "consisting or organic chelating agents," should read --consisting of organic chelating agents,--.

Signed and Sealed this

Twentieth Day of December, 1994

Bruce Lehman

*Attest:*

BRUCE LEHMAN

*Attesting Officer*

*Commissioner of Patents and Trademarks*